US007908944B2

(12) United States Patent
Nason et al.

(10) Patent No.: US 7,908,944 B2
(45) Date of Patent: Mar. 22, 2011

(54) MULTI-FUNCTION TOOL WITH LOCKING PLIERS

(75) Inventors: John Nason, Keizer, OR (US); Hal Hardinge, Tigard, OR (US); Edward M. Wallace, Portland, OR (US)

(73) Assignee: Fiskars Brands, Inc., Madison, WI (US)

( * ) Notice: Subject to any disclaimer, the term of this patent is extended or adjusted under 35 U.S.C. 154(b) by 231 days.

(21) Appl. No.: 12/274,850

(22) Filed: Nov. 20, 2008

(65) Prior Publication Data

US 2010/0122420 A1 May 20, 2010

(51) Int. Cl.
*B25B 7/12* (2006.01)
*B25B 7/22* (2006.01)

(52) U.S. Cl. ..... 81/367; 7/128

(58) Field of Classification Search ..... 81/367, 81/318–320; 7/125–129
See application file for complete search history.

(56) References Cited

U.S. PATENT DOCUMENTS

| | | | | |
|---|---|---|---|---|
| 2,478,696 | A | 8/1949 | Isele | |
| 3,094,020 | A * | 6/1963 | Wise | 81/13 |
| 4,238,862 | A | 12/1980 | Leatherman | |
| 4,744,272 | A | 5/1988 | Leatherman | |
| 5,119,520 | A * | 6/1992 | Finn | 7/127 |
| 5,142,721 | A * | 9/1992 | Sessions et al. | 7/128 |
| 5,212,844 | A | 5/1993 | Sessions et al. | |
| 5,564,318 | A | 10/1996 | Pail | |
| 5,664,274 | A | 9/1997 | Collins | |
| 5,697,114 | A | 12/1997 | McIntosh et al. | |
| 5,781,950 | A | 7/1998 | Swinden et al. | |
| 5,963,999 | A | 10/1999 | Gardiner et al. | |
| 6,003,180 | A | 12/1999 | Frazer | |
| 6,006,385 | A | 12/1999 | Kershaw et al. | |
| 6,009,582 | A | 1/2000 | Harrison et al. | |
| 6,023,805 | A | 2/2000 | Lin | |
| 6,038,723 | A | 3/2000 | Nabors et al. | |
| 6,088,860 | A * | 7/2000 | Poehlmann et al. | 7/128 |
| 6,108,845 | A | 8/2000 | Hung et al. | |
| 6,185,771 | B1 | 2/2001 | Trusty, Sr. | |
| 6,219,870 | B1 | 4/2001 | Swinden et al. | |

(Continued)

FOREIGN PATENT DOCUMENTS

EP 0653975 B1 5/1995

OTHER PUBLICATIONS

European Search Report for EP Patent Application No. 09176400.1, dated Feb. 26, 2010, 6 pages.

*Primary Examiner* — David B Thomas
(74) *Attorney, Agent, or Firm* — Foley & Lardner LLP

(57) ABSTRACT

One embodiment of the invention relates to a locking pliers. The locking pliers include a pair of handles and a pair of interconnected jaws coupled to the handles. The jaws are movable between a retracted position within the handles and an extended position extending from the handles. The jaws are slidably coupled to the handles and configured to slide between the retracted position and the extended position without opening the handles. When the jaws are in the extended position, the jaws have an unclamped configuration in which the jaws are adjustable by a user to permit the jaws to lock onto objects of various sizes and clamped configuration in which the jaws are releasably locked onto an object.

17 Claims, 6 Drawing Sheets

U.S. PATENT DOCUMENTS

| | | | | |
|---|---|---|---|---|
| 6,223,374 | B1 | 5/2001 | Lin | |
| 6,282,996 | B1 | 9/2001 | Berg et al. | |
| 6,305,041 | B1 | 10/2001 | Montague et al. | |
| 6,341,423 | B1 | 1/2002 | Tagart et al. | |
| 6,405,395 | B1 | 6/2002 | Poehlmann et al. | |
| 6,450,070 | B1 * | 9/2002 | Winkler et al. | 81/367 |
| 6,487,941 | B1 | 12/2002 | Ping | |
| 6,625,832 | B2 | 9/2003 | Montague et al. | |
| 6,643,877 | B1 | 11/2003 | Amtenbrink et al. | |
| 6,691,357 | B2 | 2/2004 | Rivera | |
| 6,721,984 | B1 | 4/2004 | Harrison | |
| 6,862,961 | B2 * | 3/2005 | Winkler | 81/367 |
| 7,039,974 | B2 | 5/2006 | Berg | |
| 7,150,210 | B2 | 12/2006 | Berg et al. | |
| 7,347,128 | B2 | 3/2008 | Rivera et al. | |
| 7,363,669 | B2 | 4/2008 | Berg et al. | |
| 7,437,978 | B1 * | 10/2008 | Aldredge | 81/367 |
| 2001/0018778 | A1 | 9/2001 | Montague et al. | |
| 2004/0003472 | A1 | 1/2004 | Dallas et al. | |
| 2004/0107549 | A1 | 6/2004 | Lin | |
| 2005/0144730 | A1 | 7/2005 | Barber et al. | |
| 2005/0274237 | A1 * | 12/2005 | Winkler | 81/367 |
| 2006/0253995 | A1 | 11/2006 | Berg et al. | |
| 2007/0283791 | A1 * | 12/2007 | Engvall et al. | 81/367 |
| 2008/0256718 | A1 * | 10/2008 | Mattson et al. | 7/127 |

* cited by examiner

MULTI-FUNCTION TOOL WITH LOCKING PLIERS

BACKGROUND OF THE INVENTION

The present application relates generally to the field of multi-function tools. More specifically, the present application relates to a multi-function tool including locking pliers.

Multi-function tools typically include a pair of handles and an implement such as a pair of scissors or pliers, along with a number of pivotally attached ancillary tools used to perform any number of tasks. There have been several attempts to integrate a locking pliers into a multi-function tool with varying results. For example, some multi-function tools include locking pliers having non-retractable jaws that result in a device that is not as compact as a tool with retractable jaws. Other multi-function tools with locking pliers require several non-intuitive steps to unfold the jaws from the handles.

SUMMARY OF THE INVENTION

One embodiment of the invention relates to a locking pliers. The locking pliers include a pair of handles and a pair of interconnected jaws coupled to the handles. The pair of jaws are movable between a retracted position within the handles and an extended position extending from the handles. The jaws are slidably coupled to the handles and configured to slide between the retracted position and the extended position without opening the handles. When the jaws are in the extended position, the jaws have an unclamped configuration in which the jaws are adjustable by a user to permit the jaws to lock onto objects of various sizes and a clamped configuration in which the jaws are releasably locked onto an object.

Another embodiment of the invention relates to a multi-function tool. The multi-function tool includes a first handle, a second handle, and an ancillary tool pivotally coupled to a first end of the first handle. The multi-function tool further includes a first jaw having a tang coupled to the first handle and a second jaw pivotally coupled to the first jaw and having a tang coupled to the second handle. The jaws are slidably coupled to the handles and configured to slide between a retracted position within the handles and an extended position extending from the handles. When the jaws are in the extended position, the jaws have an unclamped configuration in which the jaws are adjustable by a user to permit the jaws to lock onto objects of various sizes and a clamped configuration in which the jaws are releasably locked onto an object.

Another embodiment of the invention relates to a multi-function tool having a pair of handles, each having a first end and a second end. A pair of jaws is coupled to the handles and the jaws have an unclamped configuration in which the jaws are adjustable by a user to permit the jaws to lock onto objects of various sizes and a clamped configuration in which the jaws are releasably locked onto an object. An adjustment mechanism is located between the handles and between the first end and the second end to permit adjustment of the clamped configuration distance between the jaws.

The invention is capable of other embodiments and of being practiced or being carried out in various ways. It is to be understood that the invention is not limited in its application to the details of construction and the arrangements of components set forth in the following description or illustrated in the drawings. Alternative exemplary embodiments relate to other features and combinations of features as may be generally recited in the claims.

DETAILED DESCRIPTION OF THE PREFERRED EMBODIMENTS

Figure 2:
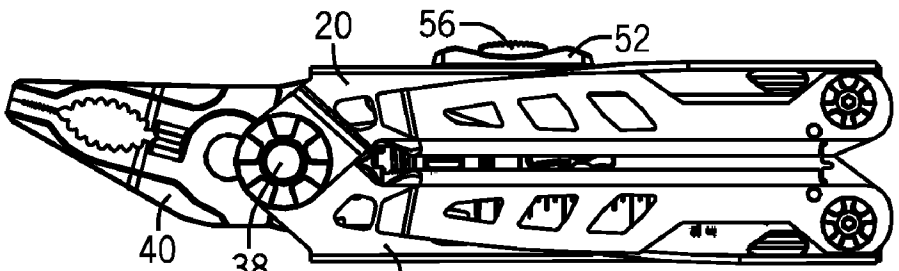
FIG. 2 is a side view of a multi-function tool of FIG. 1 with the jaws in an extended configuration.

Referring to FIGS. 1-4, a multi-function tool 10 is shown according to an exemplary embodiment. The tool 10 includes a first handle or static handle 20, a second handle or toggle handle 30, a number of ancillary tools 28 pivotally attached to one or both handles 20 and 30 (see FIG. 4), and a retractable jaw assembly 40 (see FIGS. 2-3). In the exemplary embodiment shown in FIGS. 1-4, the multi-function tool 10 includes a pair of locking pliers.

Figure 4:
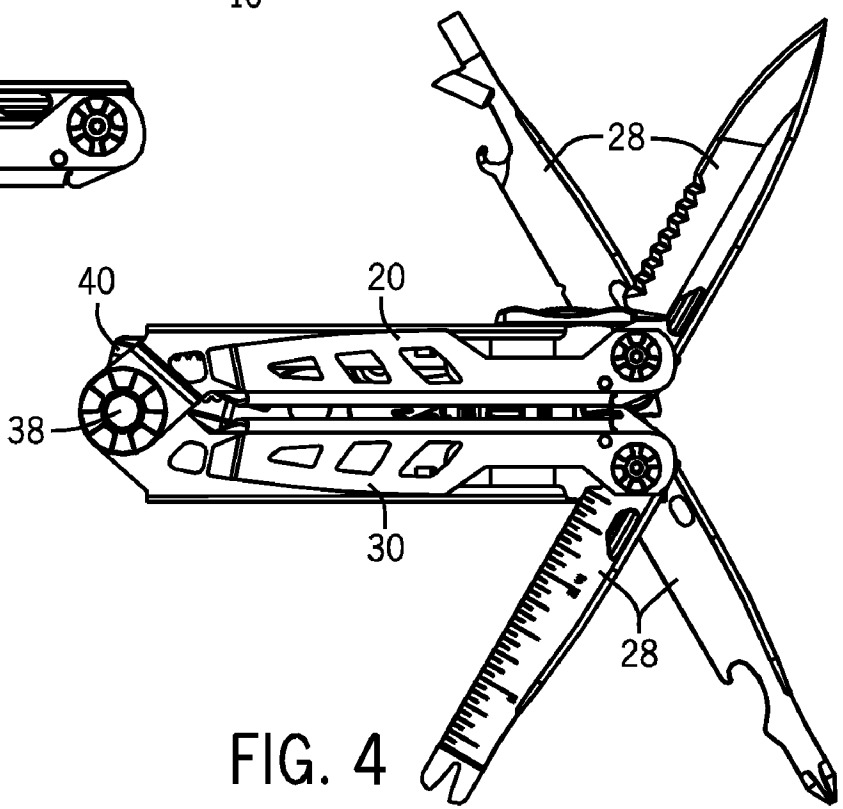
FIG. 4 is a side view of a multi-function tool of FIG. 1 with several tools or implements deployed from the handles of the multi-function tool.
Figure 1:
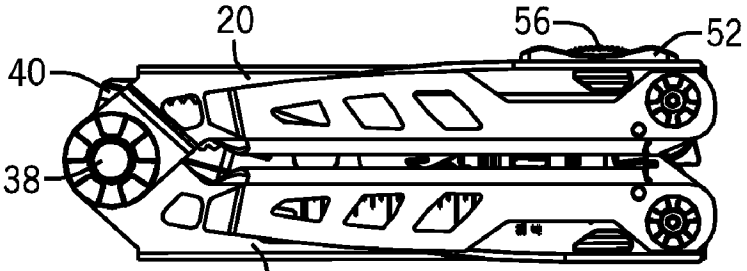
FIG. 1 is a side view of a multi-function tool according to an exemplary embodiment with the jaws in a retracted configuration.
Figure 3:
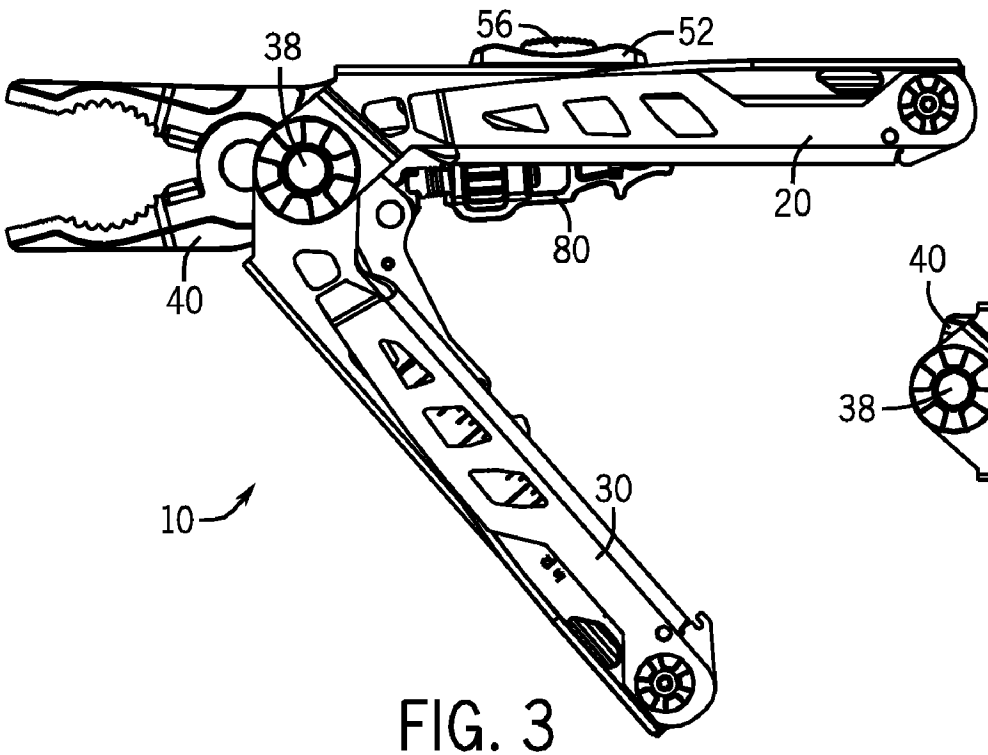
FIG. 3 is a side view of a multi-function tool of FIG. 1 with the jaws in an extended and open configuration.

Referring to FIGS. 1 and 4, multi-function tool 10 may have a compact or retracted configuration in which the jaw assembly 40 is stowed within the handles 20, 30. The compact configuration is useful for storing the multi-function tool 10 when not in use, permitting carrying in a pocket or attaching to a belt. The jaw assembly 40 may be moved to a deployed or extended configuration as shown in FIGS. 2-3 to allow a user to open and close handles 20, 30 to manipulate jaw assembly 40.

The first handle 20 and second handle 30 are coupled together at one end with a pivot mechanism, such as a pair of rivets 38. The rivets 38 allow the handles 20 and 30 to pivot relative to each other and operate jaw assembly 40. As shown best in FIG. 4, according to one exemplary embodiment, a wide variety of ancillary tools 28 may be coupled to one or both of handles 20, 30. Exemplary types of tools 28 include blades, screwdrivers, bottle openers, can openers, scissors, files, box openers, and the like. One or both handles 20, 30 may have a channel (or multiple channels) configured to house the ancillary tools 28, the channel(s) open toward the exterior of the multi-function tool 10 permitting a user to pivotally open and close ancillary tools 28 when multi-function tool 10 is in the compact configuration, as shown in FIG. 4.

Figure 5:
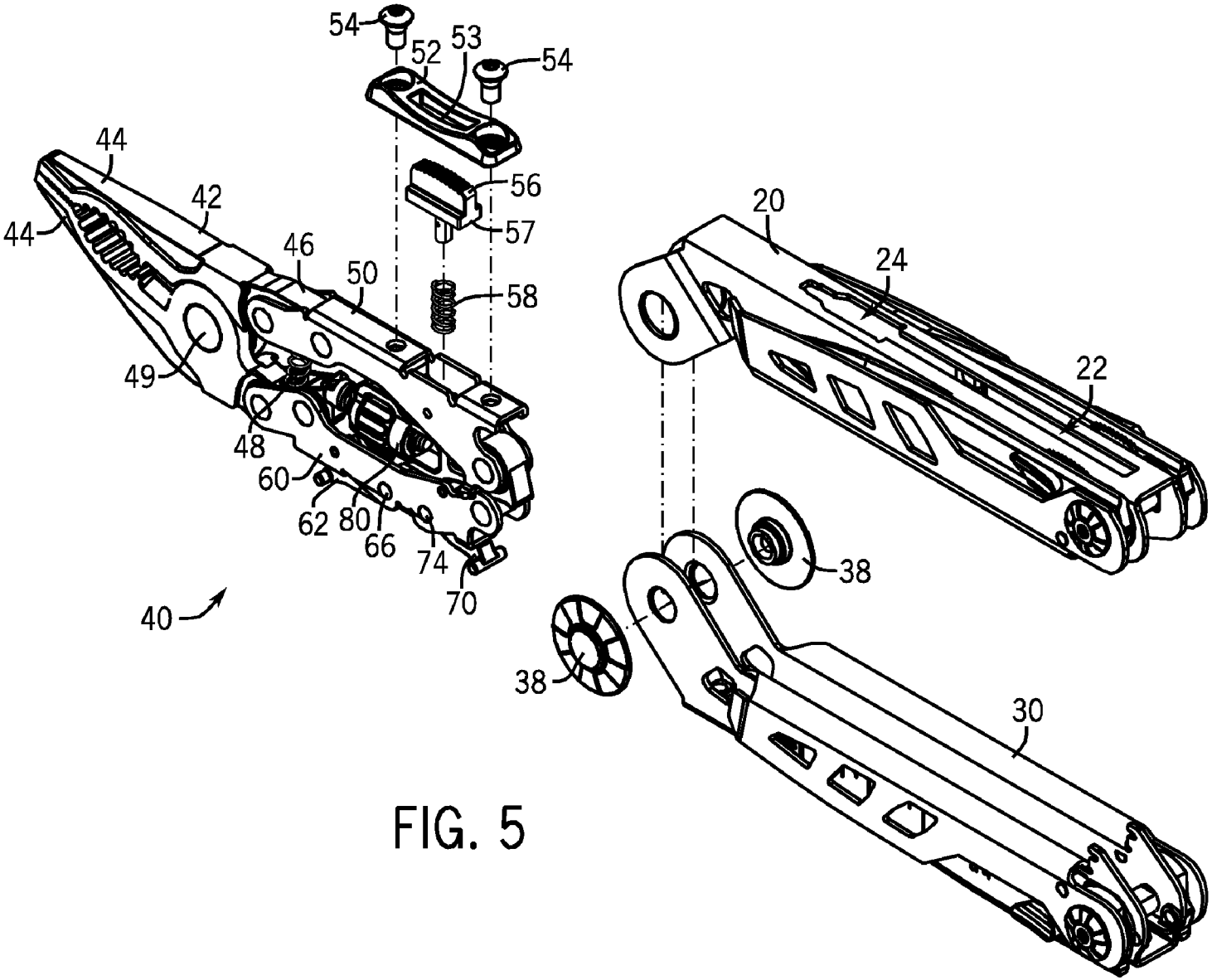
FIG. 5 is an exploded view of the multi-function tool of FIG. 1.

Referring now to FIG. 5, an exploded view shows the jaw assembly 40 according to an exemplary embodiment. The jaw assembly 40 is coupled to the first handle 20 and the second handle 30 such that the jaw assembly 40 can slide relative to the handles 20, 30 between a compact or retracted position and a deployed or extended position. The jaw assembly 40 includes a pair of jaws 42. A first end of the jaws 42 forms working portions 44 and a second end of the jaws 42 forms tangs 46 (see also FIGS. 8-11). The tangs 46 are coupled to the handles 20, 30 via links, shown as a first or static saddle 50 and a second or toggle saddle 60. The jaws 42 are coupled together at a pivot point 49 between the working portions 44 and the tangs 46. A biasing member such as a spring 48 may be included. According to an exemplary embodiment, spring 48 is an extension spring coupled to the tangs 46 and is configured to bias the tangs 46 toward each other and, in turn, bias the working portions 44 away from each other. In another embodiment, one end of the extension spring may be attached to the static saddle 50 instead of the tang 46 while still biasing the working portions 44 away from each other.

The first saddle 50 and the second saddle 60 are each coupled to one of the tangs 46 and to an adjustment linkage or a mechanism, shown as a toggle assembly 80, that allows a user to adjust positioning of the second saddle 60 relative to the first saddle 50 and positioning of the working portions 44 relative to each other. The first saddle 50 and the second saddle 60 are slidably coupled to the first handle 20 and the second handle 30, respectively.

Figure 6:
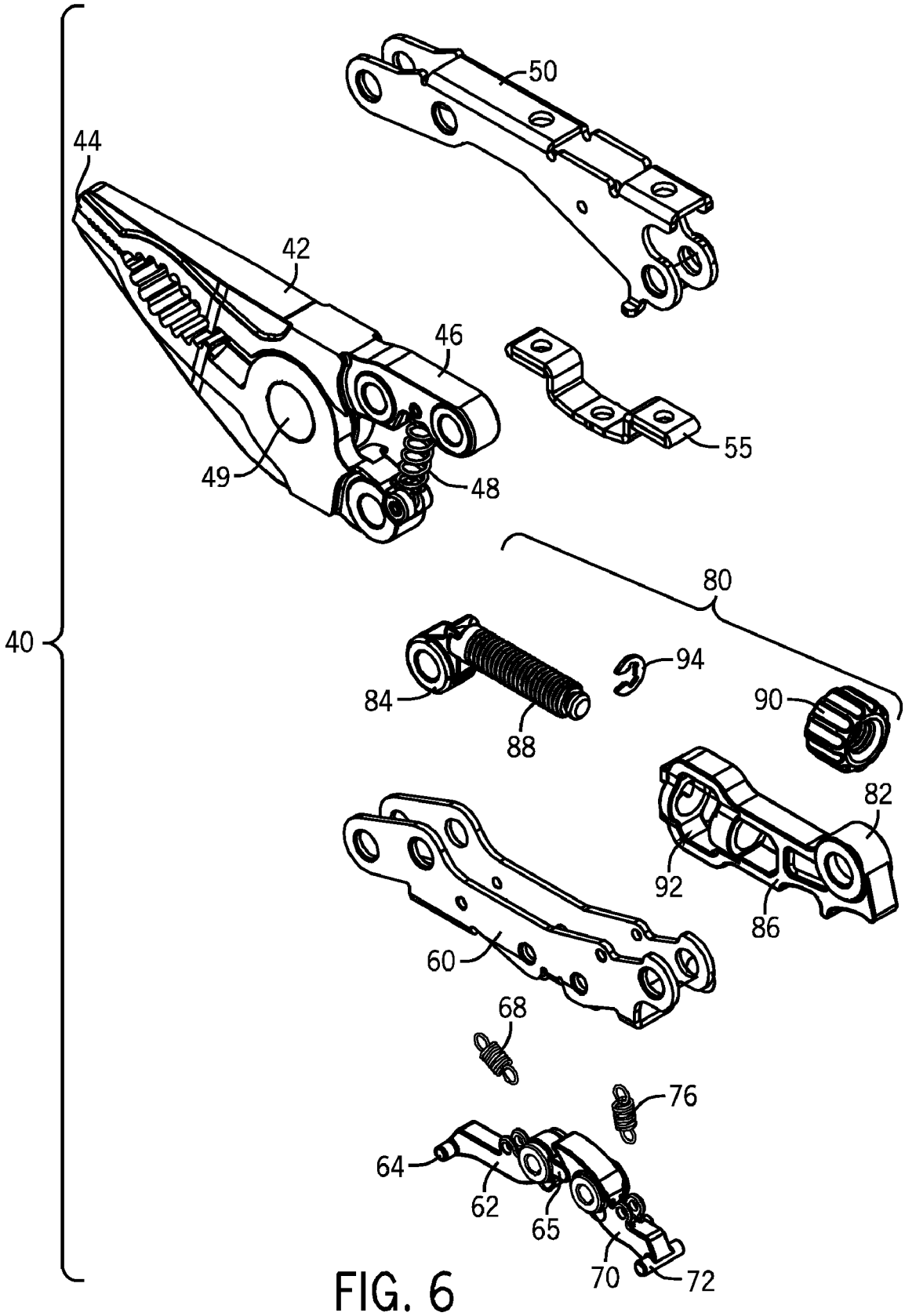
FIG. 6 is an exploded view of the jaw assembly of the multi-function tool of FIG. 1.

The jaw assembly 40 is slidably coupled to first handle 20 with a sliding mechanism in the form of a slide cap 52 that is coupled to the first saddle 50 with fasteners 54. The slide cap 52 and the first saddle 50 are provided on opposite sides of a wall of the first handle 20 and the fasteners 54 are received by a first slot 22 (e.g., a narrow slot) that runs along the first handle 20. A second wide slot or opening 24 is provided on one end of the first slot 22 (e.g., proximate to rivets 38) and is connected to the first slot 22. The fasteners 54 are also coupled to a button retainer 55 (FIG. 6). A slide button 56 is provided with a shoulder 57 that is trapped between the button retainer 55 and the slide cap 52. A portion of the button 56 extends out through a button opening 53 in the slide cap 52. A biasing member such as a spring 58 is provided to bias the button 56 outward, away from the button retainer 55. The first slot 22 has a width that is large enough to receive a portion of the button 56 but too narrow to allow the shoulder 57 of the button 56 to pass through. The second slot 24 is wide enough to receive the shoulder 57 of the button 56.

To deploy the jaw assembly 40 (e.g., to move the jaw assembly 40 from the compact or retracted configuration to the deployed or extended configuration) a user forces the jaw assembly 40 forward either by pushing forward on the button 56 or by "flicking" the tool 10 such that momentum of the jaw assembly 40 forces jaw assembly 40 forward (e.g., towards the end of the handles 20, 30 coupled together with rivets 38). As the jaw assembly 40 moves forward, the button 56 slides along the first slot 22, and jaw assembly 40 does not pivot forward. When the button 56 is aligned with the second slot 24, the spring 58 forces the button 56 upward such that the shoulder 57 is received in the second slot 24. Because the shoulder 57 is too wide to be received in the first slot 22, the button 56 cannot slide until the shoulder 57 is disengaged and therefore functions as a lock for the jaw assembly 40 locking jaw assembly 40 in the deployed configuration.

To return the jaw assembly 40 to the retracted position, the user may push down on the button 56 to compress the spring 58 and force the shoulder 57 out of the second slot 24, thus unlocking the jaw assembly 40. The user may then pull back on the button 56 to slide it into the first slot 22. The jaw assembly 40 is retracted by either continuing to pull back on the button 56 until the jaw assembly 40 is fully retracted or to turn the tool 10 upright (e.g., in a vertical position) and tapping it against a surface such that momentum of the jaw assembly 40 forces it into the retracted position.

Figure 14:
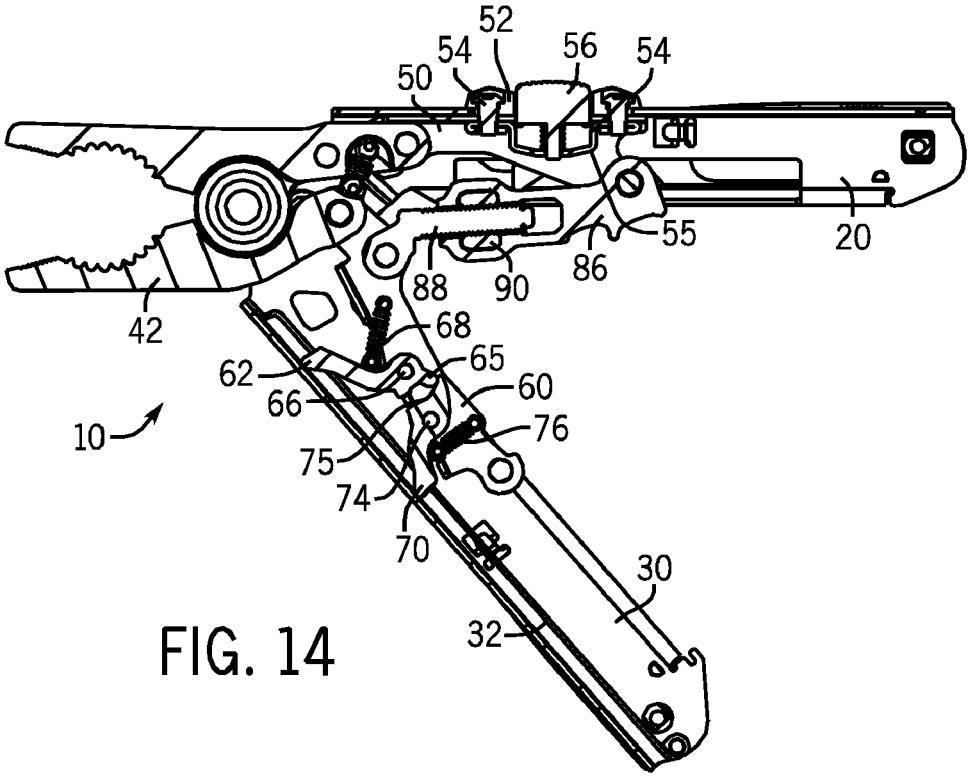
FIG. 14 is a cross section of the multi-function tool of FIG. 12 taken along line 14-14 with the jaws in an extended configuration.

The jaw assembly 40 maintains contact with the second handle 30 with a fore pawl 62 and an aft pawl 70 that are coupled to the second saddle 60. The fore pawl 62 and the aft pawl 70 slide along and are retained by a slide rail 32 (see FIGS. 7 and 14) on the second handle 30. According to one exemplary embodiment, the slide rail 32 is separately formed and coupled to the second handle 30 (e.g., with rivets). According to another exemplary embodiment, the slide rail 32 may be integrally formed with the second handle 30 as built-in walls, ridges, etc. The fore pawl 62 and the aft pawl 70 include arms (extensions, pegs, etc.) 64 and 72, respectively, that are trapped between the slide rail 32 and the second handle 30. The arms 64, 72 partially prevent the fore pawl 62 and the aft pawl 70 from being pulled away from the second handle 30 while still allowing the fore pawl 62 and the aft pawl 70 (as well as the second saddle 60 and the rest of the jaw assembly 40) to slide along the length of the second handle 30.

The fore pawl 62 and the aft pawl 70 each rotate about their own pivot points. The fore pawl 62 pivots about a first pivot pin 66 (see FIGS. 5 and 14) that couples the fore pawl 62 to the second saddle 60. The aft pawl 70 pivots about a second pivot pin 74 (see FIGS. 5 and 14) that couples the aft pawl 70 to the second saddle 60. By having different pivot points 66, 74, both the fore pawl 62 and the aft pawl 70 can always maintain contact with the lock slide rail 32 as the second saddle 60 pivots with respect to the second handle 30 as the jaws 42 are opened and closed.

Figure 13:
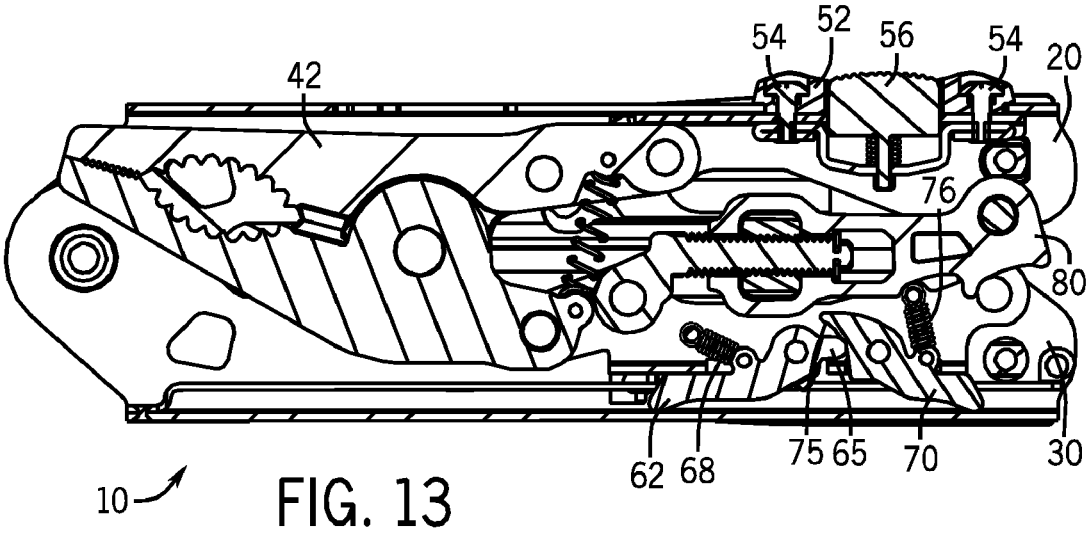
FIG. 13 is a cross section of the multi-function tool of FIG. 12 taken along line 13-13 with the jaws in a retracted configuration.

Referring now to FIG. 6, an exploded view of the jaw assembly 40 is shown according to an exemplary embodiment. The fore pawl 62 includes a protrusion or nose 65 that is in contact with a curved bearing surface 75 (see FIG. 13) on the aft pawl 70 so that a movement in one of the pawls 62 or 70 may impose a movement in the other. Springs 68 and 76 are coupled to the second saddle 60 and to the fore pawl 62 and the aft pawl 70, respectively, to maintain rotational tension on the fore pawl 62 and the aft pawl 70. The rotational tension helps to maintain a constant contact between the protrusion 65 and the bearing surface 75.

A toggle 80 is coupled on a first end 82 to the first saddle 50 and on a second end 84 (opposite to end 82) to the second saddle 60. The first end 82 is provided on a toggle yoke 86 while the second end 84 is provided on a threaded toggle eye 88. The yoke 86 forms a longitudinal shaft or opening that is configured to receive the eye 88.

The yoke 86 further includes an opening 92 that is configured to receive an adjustment wheel 90. The adjustment wheel 90 is a cylindrical member with a threaded central opening that engages the threaded toggle eye 88. The opening 92 in the yoke 86 is aligned with the longitudinal shaft in the yoke 86 and allows the adjustment wheel 90 to rotate while still remaining in the yoke 86. In this way, with the toggle eye 88 engaging the adjustment wheel 90, the adjustment wheel 90 may be turned to move the eye 88 relative to the yoke 86. A retainer, such as a clip 94, may be coupled to an end of the eye 88 to prevent the eye 88 from being moved out of the adjustment wheel 90 and disengage from the threaded opening in the adjustment wheel 90. Moving the eye 88 relative to the yoke 86 in turn moves the second end 84 of the toggle 80 relative to the first end 82 of the toggle 80, effectively lengthening or shortening the toggle 80. By adjusting the toggle 80 with the adjustment wheel 90, a user can change the length of the toggle 80 and the orientation of the first saddle 50 and the second saddle 60 to in turn adjust the orientation and range of motion of the jaws 42.

Figure 7:
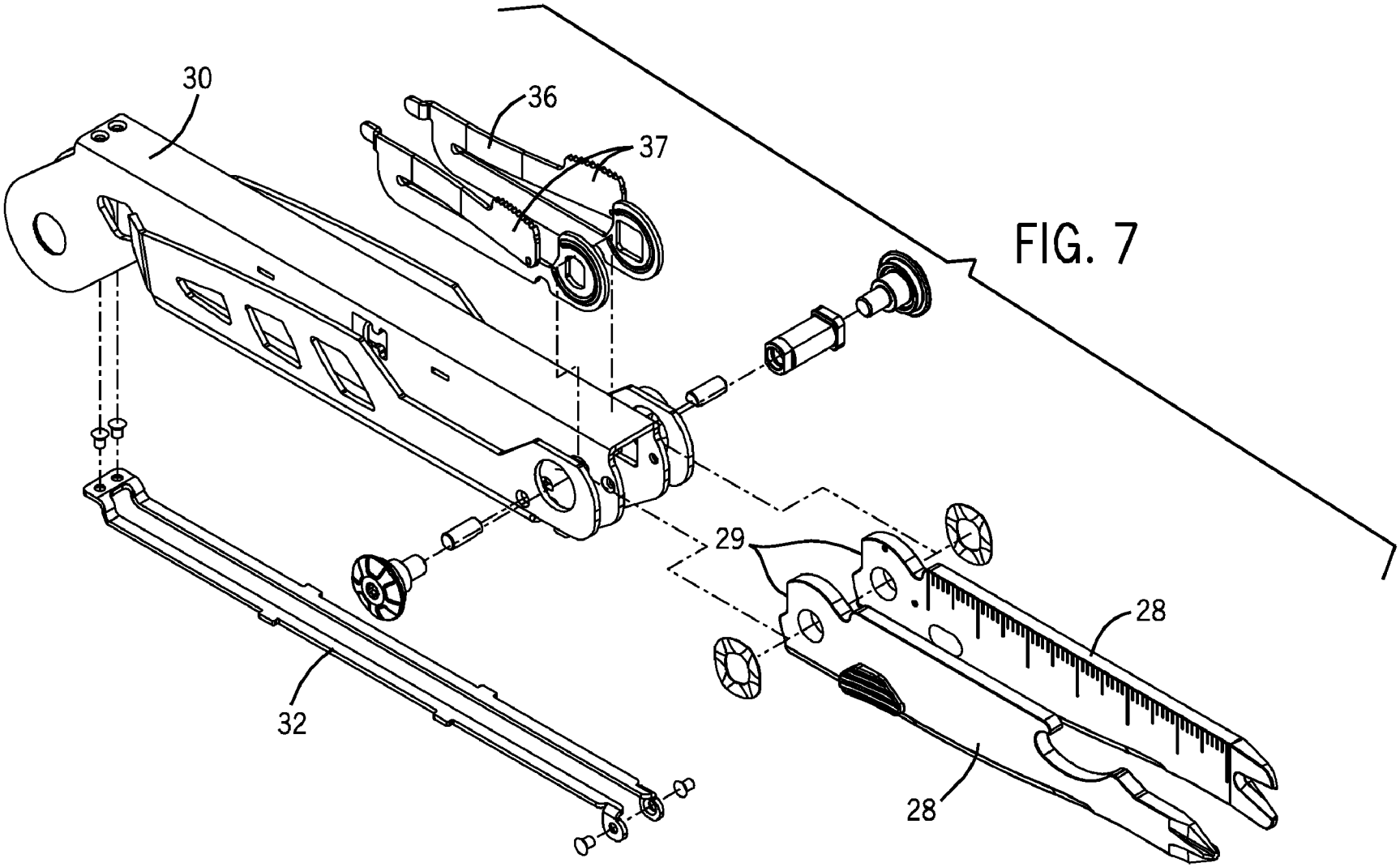
FIG. 7 is an exploded view of one of the handles of the multi-function tool of FIG. 1.

In the embodiment shown in FIG. 7 (presenting vantage point different than the FIG. 5 view), the second handle 30 includes a locking mechanism with a lock 36 that is configured to selectively lock one of the ancillary tools 28 in a deployed position (e.g., a functional position, extended from the second handle 30). A tang of the ancillary tool 28 includes a flat or cutout 29. According to an exemplary embodiment, lock 36 includes a spring arm 37. The spring arm 37 is biased against a side of the ancillary tool 28. When the ancillary tool 28 is moved into the deployed position, the cutout 29 allows the spring arm 37 to move into a space behind the ancillary tool 28, locking the ancillary tool 28 in the deployed position. Some ancillary tools 28 (i.e., screwdrivers, saws, files, etc.) may experience forces when in use that are countered by the lock 36 allowing the ancillary tool 28 to remain in the deployed position. A user may unlock the ancillary tool 28 by pressing on the spring arm 37 to move it out from behind the ancillary tool 28 and rotate the ancillary tool 28 into a stored position within the handle 30. While FIG. 7 shows the second handle 30, it should be understood that a similar locking mechanism may be provided for ancillary tools 28 in the first handle 20.

Figure 9:
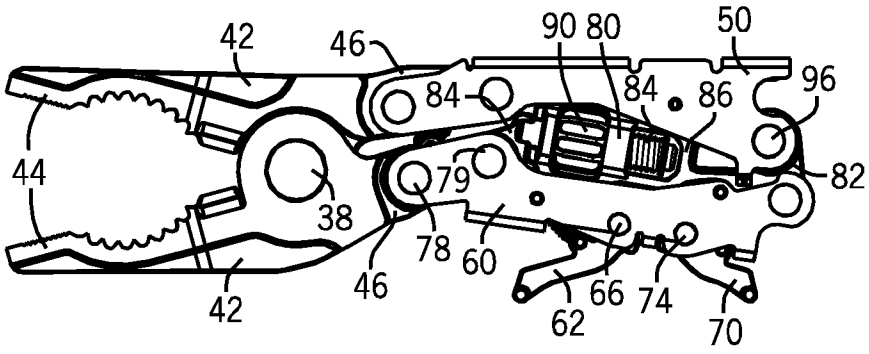
FIG. 9 is a side view of the jaw assembly in an clamped configuration with the jaws adjusted to a second position.
Figure 8:
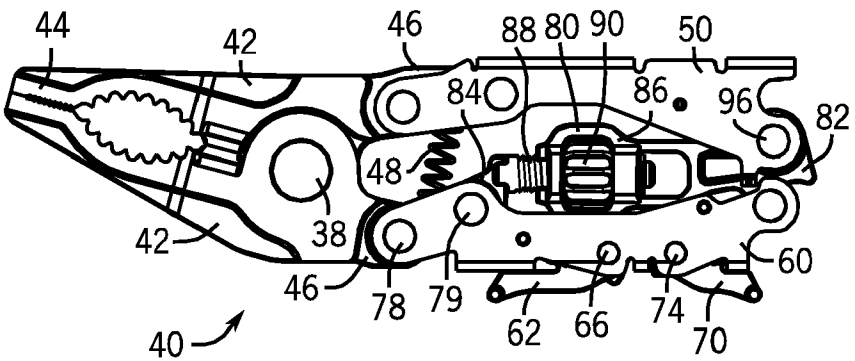
FIG. 8 is a side view of the jaw assembly in a clamped configuration with the jaws adjusted to a first position.
Figure 11:
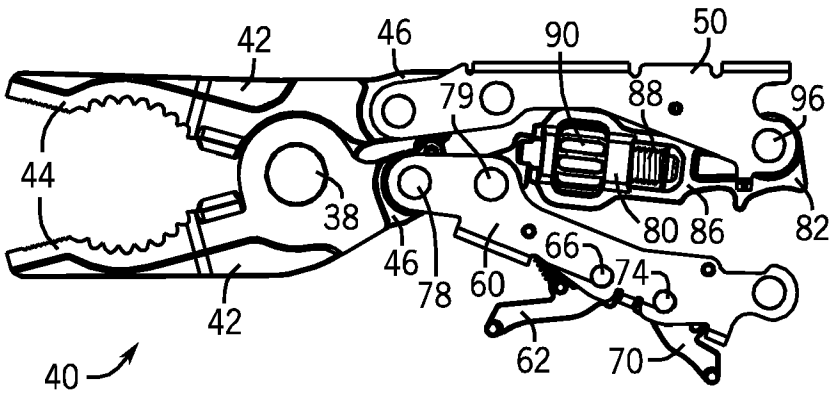
FIG. 11 is a side view of the jaw assembly in an unclamped configuration with the jaws adjusted to a second position.
Figure 10:
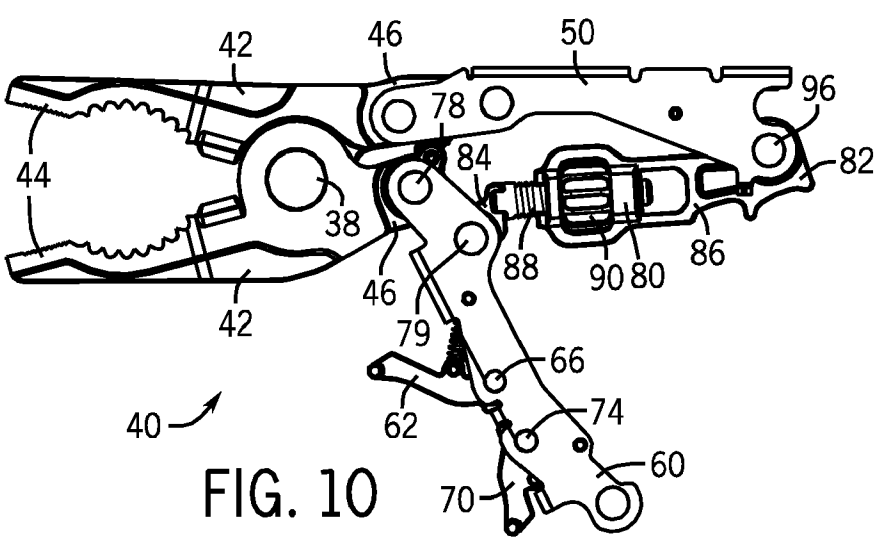
FIG. 10 is a side view of the jaw assembly in a unclamped configuration with the jaws adjusted to a first position.
Figure 12:
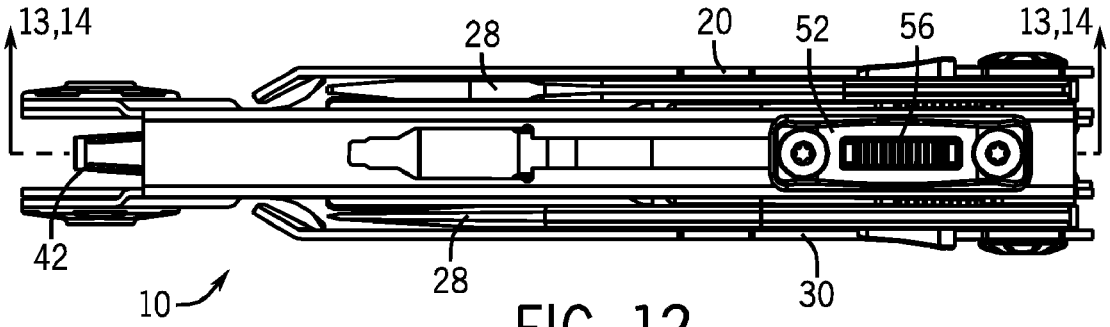
FIG. 12 is a top view of the multi-function tool of FIG. 1.

Referring now to FIGS. 8-11, the jaw assembly 40 is shown both open (FIGS. 10 and 11) and closed (FIGS. 8 and 9) in both a maximum adjustment position (FIGS. 9 and 11) and a minimum adjustment position (FIGS. 8 and 10). In the minimum adjustment position, the toggle 80 is adjusted so that the first end 82 and the second end 84 of the toggle 80 are at a maximum distance from each other and the working portions 44 of the jaws 42 are at a minimum distance from each other (e.g., touching at the tip) when the jaws 42 are closed. In the maximum adjustment position, the toggle 80 is adjusted so that the first end 82 and the second end 84 of the toggle 80 are at a minimum distance (e.g., the toggle eye 88 is fully seated in the toggle yoke 86) from each other and the working portions 44 of the jaws 42 are spaced apart from each other when the jaws 42 are closed.

The pawls 62, 70 are provided to compensate for a differing pivot axis for the second handle 30 (see FIGS. 1-4) and the second saddle 60. The second handle 30 rotates around the rivet 38 and the second saddle 60 rotates around a first saddle pivot 78.

The variation in the positions of the jaws 42 in the minimum and maximum positions is caused by a linkage formed between the saddles 50, 60, the jaws 42, and the handles 20, 30 (see FIGS. 1-4). The jaw assembly 40 is configured to grip and hold items using an over-the-center toggle clamp mechanism. In the open configuration, the jaw spring 48 pulls the jaw tangs 46 together, thereby opening the jaws 42. As the second saddle 60 is pulled toward the first saddle 50 (when the handle 20, 30 are squeezed together), the second saddle 60 rotates around a second saddle pivot 79, and the jaw tangs 46 move away from each other, causing the working portions 44 to close.

In the closed or clamped position, the jaws 42 are held in place (e.g., releasably locked) by an over-the-center condition between the forces at the first saddle pivot 78 and the second saddle pivot 79 (see FIGS. 8 and 9). The over-the-center condition locks the jaws 42 in the closed or clamped position until the tool 10 is manually released or unclamped by a user. This locking feature allows a user to clamp down on an object with the tool 10 without having to maintain pressure on the handles 20, 30, leaving the user's hand available for another task.

The jaw assembly 40 opening angle can be adjusted by changing the distance between the first end 82 and the second end 84 of the toggle 80 (i.e., the distance between the toggle pivot pin 96 and the second saddle pivot 79). The shorter the distance, the larger the opening that will be formed by the jaws 42 in the closed or clamped position and the larger an object that can be clamped with the tool 10. As described above, the distance may be adjusted by rotating the adjustment wheel 90 around the threaded portion of the toggle eye 88. The adjustment wheel 90 pulls the toggle yoke 86 towards the second saddle pivot 79.

In the embodiment shown FIG. 3, the toggle 80 and the adjustment wheel 90 are between the first handle 20 and the second handle 30 proximate to the jaws 42 so that the adjustment wheel 90 may be manipulated by a user with the same hand that is holding the tool 10. In this way, the user can adjust the size of the opening formed by the jaws 42 in the clamped position without having to reach to the back end of the tool with the other hand to make the adjustment as is the case with certain conventional locking pliers. The user may therefore use the other hand for another task such as holding the object to be clamped or other tools.

It is important to note that the construction and arrangement of the multi-function tool as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. While the detailed drawings, specific examples, and particular formulations given describe certain exemplary embodiments, they serve the purpose as illustration only. The invention is not limited to the specific forms shown. The configuration of multi-function tool may differ depending on chosen performance characteristics and physical characteristics of the components of the multi-function tool. For example, the implement may take a variety of configurations and perform different functions depending on the needs of the user. Furthermore, other substitutions, modifications, changes, and omissions may be made in the design, operating conditions, and arrangement of the exemplary embodiments without departing from the scope of the invention as expressed in the appended claims. Elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention

What is claimed is:

1. Locking pliers, comprising:

a first handle and a second handle;

a pair of interconnected jaws slidably coupled to the handles, wherein the pair of jaws are configured to slide between a retracted position within the handles and an extended position extending from the handles, wherein the pair of jaws comprise a first jaw and a second jaw, wherein the first jaw is coupled to the first handle via a first sliding mechanism that permits the first jaw to slide, but not pivot, relative to the first handle, and the second jaw is coupled to the second handle via a second sliding mechanism that is pivotally coupled to the second jaw, wherein the second sliding mechanism comprises a link pivotally coupled to the second jaw and a pair of pawls slidably and pivotally coupled to the second handle; and wherein when the jaws are in the extended position, the jaws have an unclamped configuration in which the jaws are adjustable by a user to permit the jaws to lock onto objects of various sizes and a clamped configuration in which the jaws are releasably locked onto an object.

2. The locking pliers of claim 1, further comprising a lock configured to lock the jaws in the extended position until manually released by a user.

3. The locking pliers of claim 1, further comprising an adjustment mechanism located between the handles to permit the adjustment of the jaws with a single hand when the jaws are in the extended and unclamped configuration.

4. The locking pliers of claim 1, further comprising an ancillary tool pivotally coupled to one of the handles and configured to pivot between a stored position within the handle and a deployed position extending from the handle.

5. The locking pliers of claim 4, further comprising a lock configured to lock the ancillary tool into the deployed position.

6. The locking pliers of claim 1, wherein the pawls are each pivotally coupled to the link whereby the link pivots with respect to the second handle as the pair of jaws are opened and closed.

7. The locking pliers of claim 1, further comprising an adjustment linkage connected between the first sliding mechanism and the second sliding mechanism, the adjustment linkage comprising an adjustment wheel.

8. A multi-function tool, comprising:

a first handle;

a second handle;

an ancillary tool pivotally coupled to a first end of the first handle;

a first jaw having a tang coupled to the first handle via a first sliding mechanism;

a second jaw pivotally coupled to the first jaw and having a tang coupled to the second handle via a second sliding mechanism; and an adjustment linkage connected between the first sliding mechanism and the second sliding mechanism;

wherein the jaws are configured to slide between a retracted position within the handles and an extended position extending from the handles; and wherein when the jaws are in the extended position, the jaws have an unclamped configuration in which the jaws are adjustable by a user to permit the jaws to lock onto objects of various sizes and a clamped configuration in which the jaws are releasably locked onto an object.

9. The multi-function tool of claim 8, further comprising a lock configured to lock the jaws in the extended position relative to the handles until manually released by a user.

10. The multi-function tool of claim 8, further comprising an adjustment mechanism located between the handles to permit the adjustment of the jaws with a single hand when the jaws are in the extended and unclamped configuration.

11. The multi-function tool of claim 8, wherein the ancillary tool pivots between a stored position within the handle and a deployed position extending from the handle.

12. The multi-function tool of claim 11, further comprising a lock configured to lock the ancillary tool into the deployed position.

13. The multi-function tool of claim 8, wherein the adjustment linkage comprises an adjustment wheel.

14. A multi-function tool, comprising:

a pair of handles, each having a first end and a second end;

a pair of jaws slidably coupled to the handles via a pair of sliding mechanisms, wherein the jaws have an unclamped configuration in which the jaws are adjustable by a user to permit the jaws to lock onto objects of various sizes and a clamped configuration in which the jaws are releasably locked onto an object; and an adjustment mechanism connected between the pair of sliding mechanisms and located between the handles and between the first end and the second end to permit the adjustment of the clamped configuration distance between the jaws.

15. The multi-function tool of claim 14, wherein the pair of jaws are slidably coupled to the handles and configured to slide between a retracted position within the handles and an extended position extending from the handles.

16. The multi-function tool of claim 14, further comprising a plurality of ancillary tools pivotally coupled to the handles.

17. The multi-function tool of claim 14, further comprising a lock configured to lock at least one of the ancillary tools into an open position.

* * * * *